United States Patent [19]

Hall

[11] 4,229,907

[45] Oct. 28, 1980

[54] SLIDE GATE

[75] Inventor: George R. Hall, Houston, Tex.

[73] Assignee: Keystone International, Inc., Houston, Tex.

[21] Appl. No.: 892,175

[22] Filed: Mar. 31, 1978

[51] Int. Cl.[3] ..... E05F 11/34

[52] U.S. Cl. ..... 49/362

[58] Field of Search ..... 49/362, 26, 360

[56] References Cited

U.S. PATENT DOCUMENTS

| | | | |
|---|---|---|---|
| 2,657,661 | 11/1953 | Robson | 49/362 X |
| 2,731,261 | 1/1956 | Drum | 49/26 X |
| 3,745,705 | 7/1973 | Keddy | 49/362 X |

FOREIGN PATENT DOCUMENTS

| | | | |
|---|---|---|---|
| 763597 | 2/1934 | France | 49/362 |

*Primary Examiner*—Kenneth Downey

*Attorney, Agent, or Firm*—Browning, Bushman & Zamecki

[57] ABSTRACT

Disclosed is a lost motion coupling for connecting a propulsion device with a load to be moved. The coupling permits the propulsion device to generate significant momentum before applying driving force to the load. In the embodiment described, a traveling nut is driven in translational motion along a rotatable screw. The traveling nut is included within the lost motion coupling between the screw and a slide gate. Significant rotational momentum may be obtained by the screw before the lost motion coupling applies driving force to the slide gate. The slide gate then experiences an abrupt application of a substantial driving force to overcome forces retarding motion of the slide gate.

10 Claims, 11 Drawing Figures

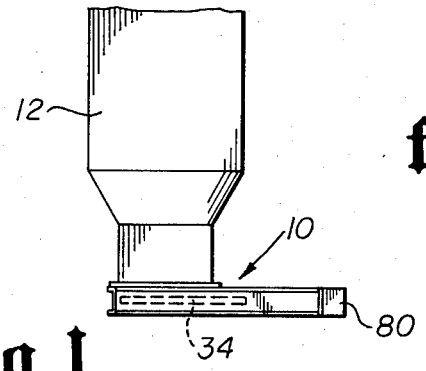
fig. 1
fig. 11
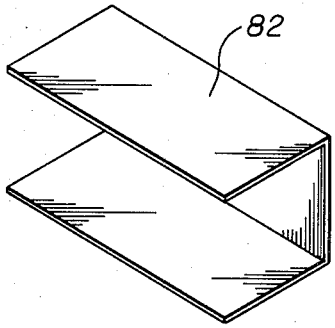
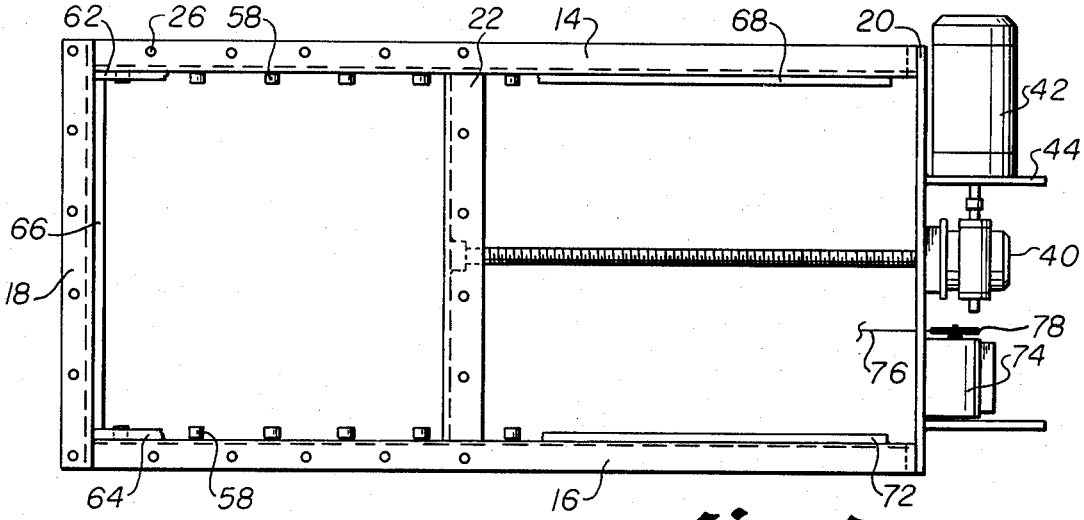
fig. 2
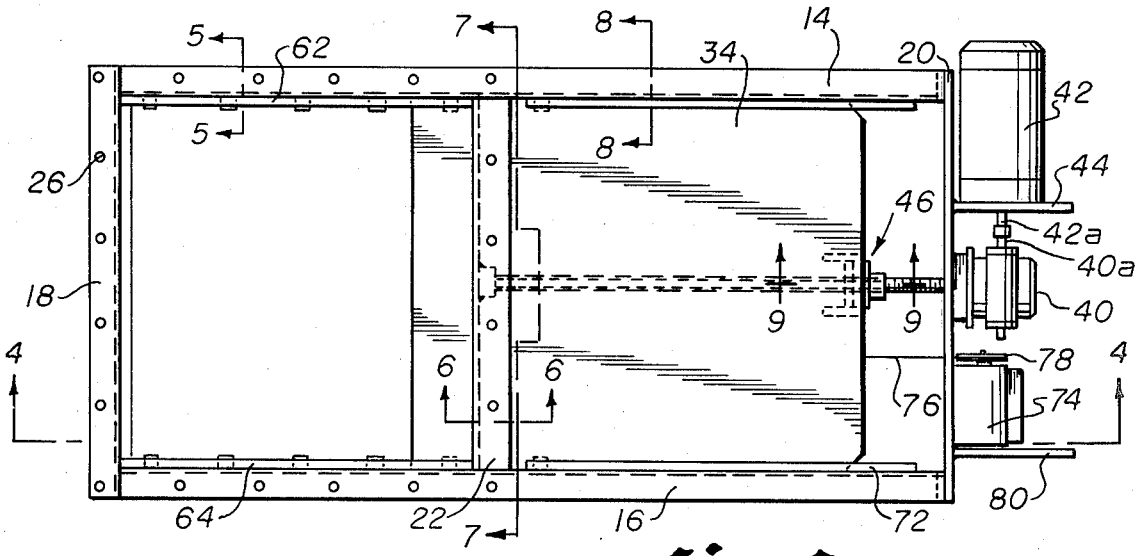
fig. 3 fig. 4
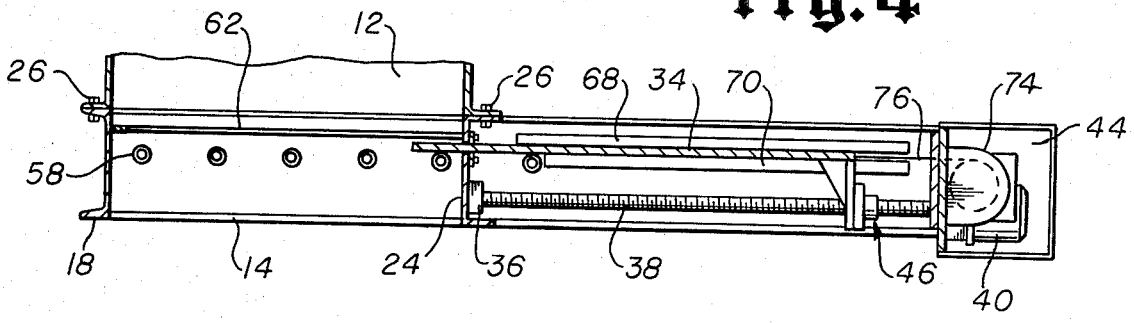
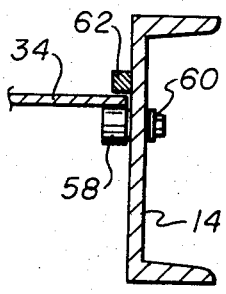
fig. 5
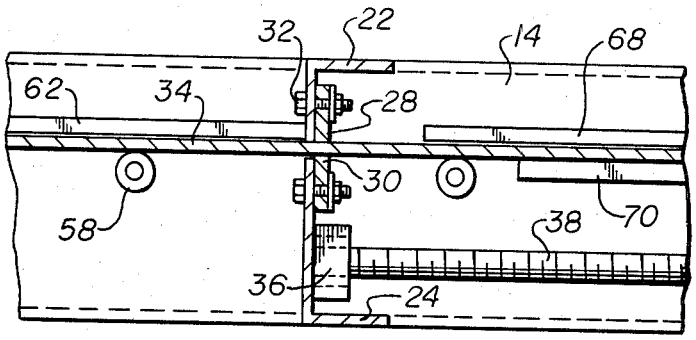
fig. 6
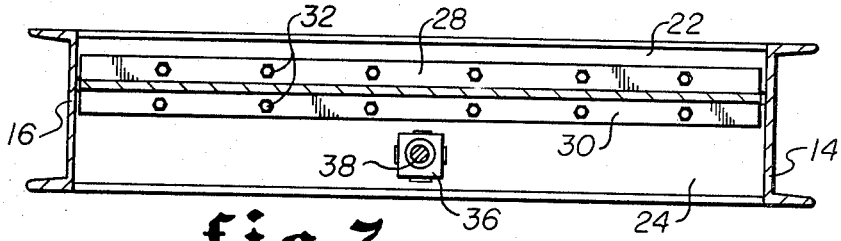
fig. 7
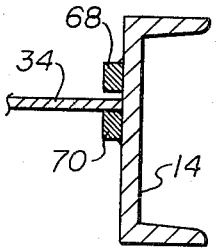
fig. 8
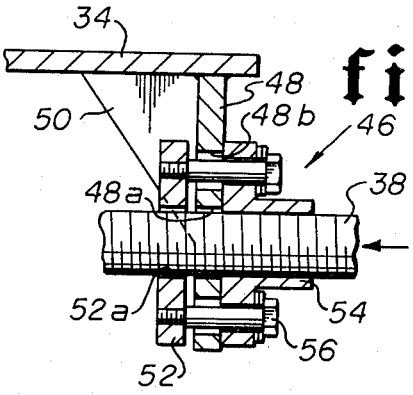
fig. 9
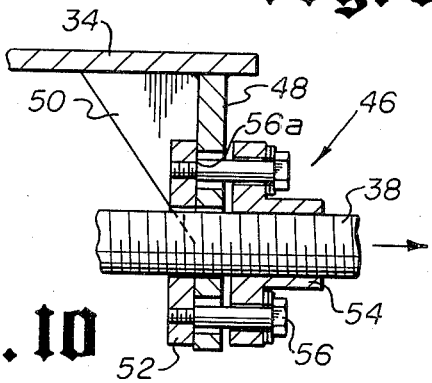
fig. 10

SLIDE GATE

BACKGROUND OF THE INVENTION

1. Field of the Invention

The present invention pertains to the techniques for imparting driving forces for moving loads. More particularly, the present invention relates to apparatus for coupling propulsion mechanisms with closure devices such as gates for transmitting driving forces thereto for opening and/or closing such devices. Apparatus according to the present invention finds specific application to slide gates used to selectively open and close passageways against the flow of material therethrough. Such slide gates, for example, may be mounted at the base of storage bins to control the removal of material from the storage bins through passageways of chutes.

2. Description of Prior Art

Storage bins, or hoppers, are often equipped with passageways emerging from the bottom of the bins whereby material stored in the bins may be selectively removed. A door, or gate, closes the passageway when material is to be stored in the bin, and then may be opened to allow material to flow down out of the bin. Such doors operate essentially as valves to control the quantity of material removed from the bins.

The bin doors, or gates, may be manually operated, or, particularly where such doors comprise large loads to move, may be operated by motors. In the latter case, such motors may, in turn, be automatically controlled to open and/or close the bin doors on command or in response to the occurence of predetermined conditions. For example, where sensors are employed to detect the level of materials in the bin control devices may be appropriately triggered to open the bin doors when the material level reaches a predetermined position within the bin. Such level detectors are discussed in detail in U.S. Pat. Nos. ,3,807,231 and 3,935,970, and U.S. Pat. applications Ser. Nos. 844,040 and 877,028, filed Oct. 20, 1977 and Feb. 10, 1978, respectively.

With the passage door or gate located towards the bottom of the bin, the gate in the closed configuration is required to support a significant portion of the weight of the material stored in the bin. Consequently, the gate must be constructed and mounted to provide a sufficiently strong support. Furthermore, the gate will often be structured as a slide gate rather than a swinging door mounted on hinges. Where the passageway is to be closed while material still remains in the bin, a sliding gate may generally be more easily moved into a close configuration rather than a swinging door which must be drawn up against the flow of material through the passage. Also, a sliding gate may be held in a partially open position with support around a greater portion of its periphery than may a swinging door.

The weight of material stored in the bin acting on a slide gate closing a passage at the bottom of the bin generates retarding forces which resist sideways movement of the slide gate to open the passage. Such retarding forces depend not only on the weight and quantity of the material in the bin, but also on the cohesiveness of the material and the degree to which it adheres to the surface of the gate. Such forces may be relatively large and, combined with the inertia of the gate itself, may provide a substantial force barrier which must be overcome by whatever means is used to impart driving forces to move the gate. Once the static friction retarding forces due to the material resting on the gate are overcome and the gate is in motion, the force applied to keep the gate in motion may be decreased. Consequently, the means employed for propelling the gate in such a situation is called upon to generate the greatest forces when the propulsion means itself is just starting in motion from a standing condition. Electric motors, which are usually used to operate such bin gates, are generally known to have the least force generating capacity under such start up conditions. Consequently, such a motor, or the linkage between the motor and the slide gate, may slip until sufficient momentum has been generated within the motor and the linkage to apply a sufficiently large force to overcome the motion retarding forces. In such applications, the driving motor may also be subject to over heating and excessive wear during such start up operations. A by-product of such an inefficient operation is waste of energy.

SUMMARY OF THE INVENTION

The present invention provides a lost motion coupling by which a propulsion device may be linked to a load to be moved. The lost motion coupling permits the propulsion device to build up non-zero momentum before applying driving forces to move the load. With the propulsion mechanism in motion, significant driving forces may be abruptly applied to the load, thereby producing a jarring action or "kick". Such jarring action causes a large initial force to be applied to the load to overcome motion retarding forces while not overtaxing the capability of the propulsion device during start up.

The present invention contemplates a slide gate for selectively opening and closing a passageway to control the flow of material therethrough. A frame is anchored in relation to the passage, and includes guides by which a slide gate may be moved to open or close the passage. In the closed configuration, the gate may be supported on all sides. Rollers are employed to both provide at least a portion of such gate support and to serve to guide the gate in motion. Furthermore, such rollers serve as bearings to facilitate the motion of the gate.

The frame also supports a driving screw mounted in bearings for rotation about the screw axis. A motor may be used to rotate the screw through a gear box. The slide gate is joined to the screw by a lost motion coupling that includes a traveling nut for converting rotational motion of the screw into translational motion of the slide gate.

The traveling nut is bolted to a follower plate which may be moved freely along the screw. A coupling plate, mounted on the slide gate, is loosely held between the traveling nut and the follower plate such that the combination of nut and follower plate may be moved a short distance in relation to the coupling plate, and, therefore, the slide gate. Thus, rotation of the screw causes the combination of traveling nut and follower plate to move a short distance before engaging the slide gate in force-imparting contact. During this initial movement by the nut and follower plate, the screw and the motor driving the screw are permitted to build up momentum free of the load of the slide gate. Consequently, by the time the slide gate is engaged for driving by the coupling, the propulsion apparatus has built up sufficient momentum to impart the aforementioned kick to the slide gate to initiate gate motion.

Use of the lost motion coupling of the present invention thus allows the propulsion apparatus to run free of excessive load during the start up periods, when the force-imparting capability of the electric motor is minimized. The large force abruptly applied then by the propulsion apparatus to the gate through the coupling overcomes the inertia of the standing gate as well as the static friction forces acting thereon, particularly where the gate is supporting a heavy load of material within a bin above. The accompanying jarring action may also aid in breaking down cohesive and/or adhesive forces of the material in the bin.

BRIEF DESCRIPTION OF THE DRAWINGS

FIG. 1 is a view in elevation partly showing a bin equipped with a slide gate according to the present invention;

FIG. 2 is a plan view of the slide gate assembly, partially broken away and with the gate removed;

FIG. 3 is a plan view of the slide gate assembly showing the gate in an open configuration;

FIG. 4 is a cross-sectional view taken along line 4—4 of FIG. 3;

FIG. 5 is a cross-sectional view taken along a line 5—5 of FIG. 3;

FIG. 6 is a cross-sectional view taken along line 6—6 of FIG. 3;

FIG. 7 is a cross-sectional view taken along line 7—7 of FIG. 3;

FIG. 8 is a cross-sectional view taken along line 8—8 of FIG. 3;

FIG. 9 is a partial cross-sectional view taken along line 9—9 of FIG. 3, showing the coupling in the configuration wherein the gate is being closed;

FIG. 10 is a partial cross-sectional view similar to FIG. 9, but showing the coupling in position as the gate is being opened; and FIG. 11 is a view in perspective of a cover used for enclosing the position transmitter and the gear box.

DESCRIPTION OF PREFERRED EMBODIMENTS

A slide gate assembly according to the present invention is shown in FIG. 1 at 10 mounted on a bin 12. The slide gate assembly 10 is positioned across the bottom passageway of the bin 12 to selectively open and close the passageway to permit or prohibit, respectively, the removal of material through the bottom of the bin. Such an application of a slide gate according to the present invention is shown in FIG. 1 for purposes of illustration rather than limitation. The present invention may be employed to control the passage of material from or to virtually any type of container, or along a flow path designed to transport material, or to simply open or close a port. However, because of the lost motion coupling used to operate the slide gate as described in detail hereinafter, the present invention is readily applicable and particularly advantageous for providing the mechanism for selectively opening and closing a bottom passageway of a material container, such as the bin 12 in FIG. 1.

Details of the construction of a slide gate assembly according to the present invention may be appreciated by reference to FIGS. 2-11. A frame assembly is constructed of two channel beams 14 and 16 serving as side arms, and terminates at one end with a channel beam 18 and at the opposite end with an end plate 20. A pair of angle beams 22 and 24 connect the two side beams 14 and 16 as best seen in FIGS. 6 and 7. The combination of beams 14, 16, 18, and 22 defines a rectangular flange which may be joined by bolts 26 to a downwardly-facing flange of comparable size and shape at the base of the bin 12 of FIG. 1. Such union of the frame of the gate assembly with the bin 12 is also indicated in FIG. 4.

As may be seen in FIGS. 6 and 7 upper and lower guide strips 28 and 30 are joined, by bolts 32, to the upper and lower angle beams 22 and 24, respectively. The guide strips 28 and 30 are positioned to substantially prohibit vertical movement of a gate 34 passing between the angle beams 22 and 24. Also, as shown in FIG. 6, the gate 34 is held generally in contact with the bottom edge of the upper angle beam 22.

A bearing block 36 is mounted on the lower angle beam 24. A screw 38 extends from the bearing block 36, where the screw rides in a ball bearing assembly (not shown), to the end plate 20 where the screw passes through an appropriate hole and is coupled to the output shaft of a right angle gear box 40 mounted on the end plate. A motor 42 is mounted on an extension plate 44 welded to the end plate 20. The output shaft 42*a* of the motor 42 is coupled to an input shaft 40*a* of the gear box 40. Thus, operation of the motor 42 to rotate the output shaft 42*a* in one sense or another produces, by way of the gear box 40, rotation of the screw 38 in one sense or another, respectively.

The gate 34 is relatively free to slide between the guide strips 28 and 30, and to advance along the side channel beams 14 and 16 toward or away from the end channel beam 18. Such sliding motion is produced by way of a coupling shown generally at 46 that converts the rotational motion of the screw 38 into translational motion of the gate 34. Details of the coupling at 46 may be appreciated by reference to FIGS. 9 and 10. A combination of a coupling plate 48 and two triangular braces 50 (only one visible in FIGS. 9 and 10) are joined to the gate 34 as a mounting bracket. The screw 38 passes through a hole 48*a* in the coupling plate 48, as well as a similar hole 52*a* in a follower plate 52.

A flanged traveling nut 54 is threadedly engaged with the screw 38 on the opposite side of the coupling plate 48 from the follower plate 52. A plurality of bolts 56 pass through an equal number of holes 48*b* in the coupling plate 48 to connect the traveling nut 54 to the follower plate 52 and prevent rotation of the traveling nut as the screw 38 is made to rotate. Thus, as the screw 38 is rotated, the traveling nut 54 is driven by the intermeshed threads of the nut and screw to move translationally without rotation. The threaded portion of the bolts 56 end in shoulders 56*a* formed by the unthreaded shanks of the bolts being of larger diameter than the threaded portions. Thus, the bolts 56 may be inserted within threaded holes of the follower plate 52 to the limit of the shoulder 56*a* and no farther. Therefore, while the bolts 56 prevent the follower plate 52 from completely separating from the traveling nut 54, the enlarged diameter unthreaded shafts of the bolts 56 define a limiting distance to which the bolts may be used to draw the follower plate and the traveling nut together. Consequently, a space is maintained between the follower plate 52 and the traveling nut 54 such that the extent of this space along the screw 38 is greater than the thickness of the coupling plate 48 along the same direction. The surplus spacing between the follower plate 52 and the traveling nut 54 provides a lost motion feature for the coupling 46.

The lost motion effect provided by the coupling 46 may be appreciated by comparing FIGS. 9 and 10. In FIG. 9, the traveling nut 54 is in contact with coupling plate 48. This is the configuration of the coupling 46 when the screw 38 is being rotated in a sense so as to drive the traveling nut 54 to the left as shown, thereby causing the gate 34 to be moved into the closed configuration. Thus, whenever the gate 34 is being moved from right to left as viewed in FIG. 3, the coupling at 46 will be in the configuration illustrated in FIG. 9. In FIG. 10, the follower plate 52 is in contact with the coupling plate 48, and the traveling nut 54 is removed from the coupling plate. This condition is achieved whenever the screw 38 is being rotated in a sense so as to propel the traveling nut 54 from left to right as shown in FIG. 10, and thereby move the gate 34 into an open configuration. Thus, whenever the gate 34 is being moved from left to right as viewed in FIG. 3, the coupling at 46 will be in the configuration illustrated in FIG. 10 .

After the gate 34 has been moved to the left to close off the passageway of the bin 12, the traveling nut 54 may be left pressed against the coupling plate 48 as shown in FIG. 9. Then, when the gate 34 is to be moved to the right to open the passageway of bin 12, the screw 38 will be turned a number of revolutions before the follower plate 52 is moved against the coupling plate to engage the gate for such movement to the right. Consequently, such opening motion of the gate 34 is initiated by a rotating screw and moving follower plate, both of which have sufficient momentum at the moment of contact of the follower plate with the coupling plate 48 to provide a "kick" to jar the gate into motion. Such a kick is not only sufficient to overcome the inertia of the gate 34 itself to place the gate in motion, but also overcomes the retarding forces exerted on the gate by the material contained within the bin 12 and pressing on the gate. In a typical application, with a gate of, for example, four square feet of closing area, a "lost motion" spacing of approximately ⅛ inch combined with a pitch of 124th inch for the screw 38 may be adequate to allow the motor 42 to provide the necessary momentum for the screw and coupling at the moment of contact of the follower plate 52 with the coupling plate 48 to initiate movement of the gate 34.

Once the gate has been opened, the coupling 46 is in the configuration illustrated in FIG. 10. A jarring action is available to start the gate 34 moving to the left from the configuration of FIG. 10, although such a jarring start may not be needed in the absence of retarding forces such as those which may be provided by material in the bin 12 pressing down on the gate to inhibit its motion from the closed configuration.

The gate 34 is further supported and guided by a combination of rollers, or roller bearings, 58 and guide strips. The rollers 58 are arranged along the side channel beams 14 and 16 to support the gate 34 when the latter is at least partially closed. A pair of rollers 58 are mounted to the right of the angle beam 22 to insure that the side edges of the gate 34 are adequately supported by rollers when the gate is in its fully closed configuration. The construction and mounting of the rollers 58 may be appreciated by reference to FIG. 5. Each roller 58 is rotationally mounted on an axle assembly which includes a bolt-like construction 60 for attachment to the channel beam.

Guide strips 62 and 64 are fixed to the side channel beams 14 and 16, respectively, to overlie the rollers 58, and prevent any upward tilting of the gate 34. The guide strips 62 and 64 also serve to effectively "seal" the gate 34 to the channel beams 14 and 16 to prevent material stored in the bin 12 from leaking around the gate when the latter is in its closed configuration. A similar guide strip 66 is joined to the end channel beam 18, and is positioned above the leading edge of the gate 34 when the latter is in its closed configuration. The virtual closure of the upper guide strip 28 and the upper angle beam 22 on the top of the gate 34 completes the sealing of the gate, ultimately to the bin 12, when the gate is in its closed configuration.

Upper and lower guide strips 68 and 70, respectively, are joined to the side channel beam 14 to the right of the angle beams 22 and 24 to provide a way to support the gate 34 when at least partially opened, and to restrain the gate against tilting. As seen in FIGS. 3 and 4, the lower guide strip 70 ends before the roller 58 to the right of the angle beams 22 and 24, while the upper guide strip 68 overlies this roller. A pair of similarly constructed guide strips 72 are mounted on the side channel beam 16 to function as do the guide strips 68 and 70.

A position transmitter 74 is mounted on the end plate 20. A cable 76 extends from the gate 34 through an appropriate hole in the end plate 20 to a reel 78 of the position transmitter 74. The reel 78 features a spring return to maintain the cable 76 taut. Thus, as the gate 34 is moved to the left, the cable 76 unwinds from the reel 78. Movement of the gate 34 to the right allows the reel 78, driven by the spring return, to wind up the cable 76. The rotational orientation of the reel 78 is thus a function of the translational position of the gate 34 relative to the end plate 20. The position transmitter 74 includes appropriate circuitry to operate a display as a function of the rotational orientation of reel 78 to thereby indicate the position of the gate 34. The position transmitter 74 also includes limit switches which may be operated when the gate is fully closed or fully open, for example, to appropriately cease the operation of the motor 42. Thus, by appropriately switching the power source, (not shown) of the motor 42 by the limit switches, the opening and/or closing of the gate 34 may be made automatic, at least to the extent of shutting off the motor when the desired gate configuration is achieved. Such position transmitters are known in the art, and are not further described herein.

An extension plate 80 is mounted on the end plate 20, and cooperates with the aforementioned extension plate 44 to support a cover 82 (FIG. 11). Thus, with the cover 82 placed around the extension plates 44 and 80, and closing against the end plate 20, the position transmitter 74 and the gear box 40 may be fully enclosed.

The present invention provides a slide gate joined to propulsion apparatus by a lost motion coupling. This coupling allows the propulsion apparatus to generate a degree of non-zero momentum before engaging the slide gate in driving-force-imparting contact. While the motor operating the propulsion apparatus is starting up, and not able to generate very large propulsion force, only elements of the propulsion apparatus itself and the coupling are being moved. It is not until the motor has gained substantial rotational momentum, and is able to impart significant torque to the driving screw, that the motor and the propulsion apparatus in general are called upon to exert large forces to move the gate.

With the gate being set in motion from a stationary configuration, and with relatively large static frictional forces present to inhibit such motion by the gate, due to the presence of material in the bin being supported by the gate, large driving forces must be applied to the gate to start the gate in motion. In the present case, the capacity for generating such forces is achieved by the propulsion apparatus before being called upon to apply such forces to the gate. Without the advantage of the lost motion coupling of the present invention, the motor would be required to be operated for a period of time, applying an ever increasing torque to the screw, without any accompanying motion of the gate due to the large retarding forces acting thereon. It would not be until the motor had generated a sufficiently large torque to overcome these retarding forces that the gate would be placed in motion.

Furthermore, without the benefit of the jarring effect provided by the sudden application of a substantially large force to the gate by way of the lost motion coupling of the present invention, the force gradually built up by the propulsion apparatus without the present invention might have to exceed in magnitude the force that may be initially applied with the present invention to just start the slide gate in motion. This is true because the jarring effect available with the present invention may in itself break down at least some of the binding between the material stored in the bin and the closed gate. Such binding may be expected to be present when the material stored in the bin is both cohesive and adhesive to the gate surface. Such conditions occur, for example, when the material stored in the bin is damp.

The construction and application of the slide gate with the lost motion coupling described herein may be varied without departing from the spirit of the invention. For example, the mechanism by which the translational motion of the gate is guided may generally be of any type. The propulsion apparatus itself may, in some instances, be all that is required to maintain orientation of the gate. Also, the same advantage of increased efficiency in overcoming forces retarding motion of the gate is available where the propulsion apparatus is operated manually rather than by means of a motor or other power device. The lost motion coupler may be constructed with the positions of the traveling nut and the follower plate relative to the coupling plate reversed, so that the nut pulls the gate open, and the follower plate pushes the gate closed. Furthermore, as noted hereinbefore, a gate according to the present invention may be used in any application for selectively opening and/or closing a passageway or port of any type. Moreover, the lost motion coupling described herein may be utilized with advantage in a variety of situations in general to provide relatively large forces, for example, to overcome forces tending to retard desired motion.

The foregoing disclosure and description of the invention is illustrative and explanatory thereof, and various changes in size, shape, and materials, as well as in the details of the illustrated construction may be made within the scope of the appended claims without departing from the spirit of the invention.

I claim:

1. Apparatus for selectively opening and closing a passageway comprising:

(a) a gate;

(b) frame means for guiding said gate;

(c) screw means mounted for rotational motion relative to said frame means; and (d) lost motion coupling means for coupling said gate to said screw means and for converting rotational motion of said screw means into translational motion of said gate, and whereby said screw means may undergo rotational motion to a predetermined extent before said coupling means so converts said rotational motion of said screw means into translational motion of said gate, further comprising:

(i) a traveling nut threadedly engaged with said screw means;

(ii) follower means;

(iii) connection means joining said traveling nut with said follower means while permitting a predetermined spacing between said traveling nut and said follower means; and (iv) coupler means fixed relative to said gate for positioning between said traveling nut and said follower means whereby said traveling nut and said follower means may each separately engage said gate to apply driving force thereto, said coupler means being sized relative to said spacing to permit motion of said traveling nut and said follower means relative to said gate corresponding to said predetermined extent of rotational motion to said screw means without conversion to translational motion of said gate.

2. Apparatus as defined in claim 1 further comprising power means for operating on said screw means to selectively produce said rotational motion of said screw means.

3. Apparatus as described in claim 1 wherein said connection means comprises bolt means for joining said traveling nut with said follower means, and shoulder means for maintaining said predetermined spacing.

4. Apparatus as described in claim 1 wherein said frame means further comprises:

(a) bearing means for supporting said gate; and (b) guide means for supporting and guiding said gate.

5. A slide gate assembly comprising:

(a) a slide gate;

(b) a frame assembly including guide means for guiding said slide gate such that said slide gate is movable within said frame assembly between a closed configuration and an open configuration;

(c) propulsion means, including an elongate screw mounted for rotational movement about its axis relative to said frame assembly;

(d) lost motion coupling means for imparting force from said screw to said slide gate, and including a traveling nut threadedly engaged with said screw and connected to said slide gate to impart driving force thereto such that said screw may be rotated, and said traveling nut moved, predetermined amounts before such driving force is applied to said slide gate by way of said traveling nut, further comprising:

(i) coupling plate means fixed relative to said slide gate for receiving such driving force;

(ii) follower plate means; and (iii) connection means for joining said follower plate means with said traveling nut with said coupling plate means extending therebetween whereby said traveling nut is generally prevented from rotating relative to said slide gate, such that said follower plate may be moved with said traveling nut said predetermined amount before such driving force is imparted to said slide gate, and such that such driving force may be imparted by said traveling nut to said coupling plate means when said screw is rotated in one rotational sense, and such driving force may be imparted by said traveling nut through said follower plate to said coupling plate when said screw is rotated in the opposite rotational sense.

6. A slide gate assembly as described in claim 5 wherein said propulsion means further comprises motor means for selectively causing said screw to rotate in one rotational sense or the other.

7. A slide gate assembly as described in claim 6 further comprising position detector means for determining the position of said slide gate and including switch means for controlling operation of said motor means.

8. A slide gate assembly as described in claim 6 further comprising a gear means for coupling said motor means to said screw.

9. A slide gate assembly as described in claim 5 wherein said connection means includes bolt means for so joining said follower plate with said traveling nut, and said bolt means includes shoulder means for limiting the extent to which said follower plate may be drawn to said traveling nut along said bolt means to permit said motion by said screw, traveling nut and follower plate before such driving force is applied to said slide gate.

10. A slide gate assembly as described in claim 5 wherein said frame assembly further comprises bearing means for supporting said slide gate.

* * * * *